US005437293A

United States Patent [19]

Colon et al.

[11] Patent Number: 5,437,293

[45] Date of Patent: Aug. 1, 1995

[54] COMBINED BRUSH AND COMB FOR APPLYING HAIR TREATMENT LIQUID

[75] Inventors: Edward Colon, Fairfield; Mary M. Schuld, Stamford; Joseph Pereira, West Redding, all of Conn.

[73] Assignee: Clairol Inc., New York, N.Y.

[21] Appl. No.: 948,624

[22] Filed: Sep. 2, 1992

Related U.S. Application Data

[63] Continuation of Ser. No. 700,383, May 3, 1991, abandoned.

[51] Int. Cl.[6] ..... A45D 24/16

[52] U.S. Cl. ..... 132/120; 132/125; 132/150

[58] Field of Search ..... 132/120, 148, 219, 150, 132/901, 125; 15/105

[56] References Cited

U.S. PATENT DOCUMENTS

| | | | |
|---|---|---|---|
| 819,444 | 5/1906 | Monroe | 132/120 X |
| 2,000,456 | 5/1935 | Schifter | 132/150 X |
| 2,270,528 | 1/1942 | Kirschenbaum | 132/125 |
| 2,270,529 | 1/1942 | Kirschenbaum | 132/125 |
| 4,993,437 | 2/1991 | Kimura et al. | 132/120 X |
| 4,993,438 | 2/1991 | Hunt | 132/139 |

FOREIGN PATENT DOCUMENTS

| | | |
|---|---|---|
| 0193059 | 2/1986 | European Pat. Off. . |
| 0948318 | 2/1964 | United Kingdom . |

*Primary Examiner*—Gene Mancene
*Assistant Examiner*—Jeffrey A. Smith
*Attorney, Agent, or Firm*—Morton S. Simon

[57] ABSTRACT

A combined brush and comb ("brush-comb") is used to apply tones, touches or streaks of hair treatment liquid to human hair. The brush-comb has a curved body portion terminating in a tip, which may be used to part the hair, and a head portion having comb tines and brush tufts positioned close to the tines. Each tine has at least one and preferably a plurality of grooves perpendicular to its axis to retain the liquid and to replenish the liquid to the brush tufts. In operation, the brush-comb head portion is dipped into a container of the liquid and then the head portion is pulled through the hair to apply touches of the liquid to selected areas of the hair.

7 Claims, 2 Drawing Sheets

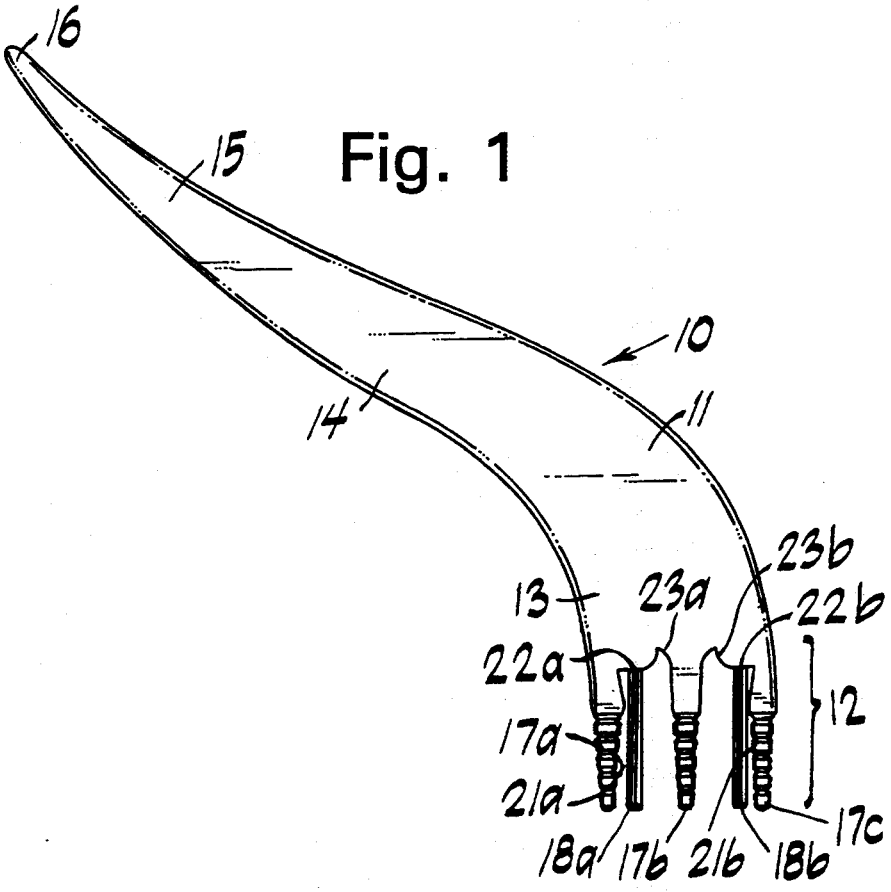
Fig. 1
Fig. 2
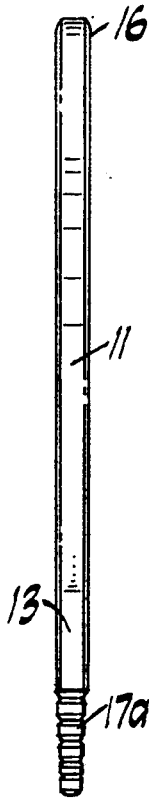
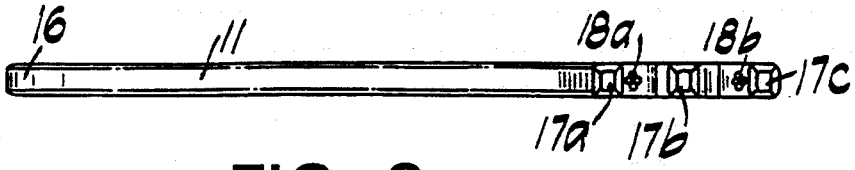
FIG. 3

COMBINED BRUSH AND COMB FOR APPLYING HAIR TREATMENT LIQUID

This application is a continuation application of application Ser. No. 07/700,383, filed May 3, 1992, now abandoned.

FIELD OF THE INVENTION

The present invention relates to small hand-held devices for applying treatment liquid to selected areas of human hair, the devices being self-exhausting and requiring multiple dipping into a liquid container.

BACKGROUND OF THE INVENTION

At the present time it is known that the entire head of human hair may be dyed or bleached, using a liquid dye or bleach, by bathing or washing the head with a treatment solution. However, the resulting hair is often uniform in color and appears unnatural.

It is also known that selected strands of hair may be colored, using a liquid dye or a bleach, to form the appearance of streaks of differently colored hair, for example of lighter or darker color or shade. Such "streaking" may present a more natural and interesting appearance then uniformly dyeing the entire head of hair.

One widely used method of hair dye streaking, often performed in hair salons (beauty parlors), involves placing on the head a rubber cap having holes. A crochet hook end is passed through the holes to pull out strands (tufts) of hair which are then dyed. In another method, strands of hair are separated, dyed and then wrapped in plastic or metal foil to keep the dyed strands separated from the rest of the hair. These methods are relatively time consuming, expensive and difficult to use at home.

A commercially available device seeks to apply hair treatment liquid to short lengths of selected hair strands. That device is a small hand device having smooth tines and two small brushes. Each brush is secured in a gullet about mid-way between two smooth tines. The device is used to apply "highlights" (light colored short streaks) or "lowlights" (dark colored short streaks) by brushing on two different hair dyes. It is intended to provide a natural look and may be used at home, i.e., applied by the user.

SUMMARY OF THE INVENTION

In accordance with the present invention there is provided a combined brush and comb ("brush-comb") for applying touches of liquid hair treatment liquid to a head of human hair. The brush-comb has a body portion and a head portion, with the body portion being curved to fit into the user's hand. The body portion preferably has a tip at its free end which may be used to part the hair into strands.

The head portion has a plurality of brush tufts and a plurality of tines parallel to the tufts. In one embodiment, it has two brush tufts and three tines. Each tine has one or more grooves in its surface, with the grooves being in planes perpendicular to its axis. Each brush tuft is closely proximate to a tine and is replenished with hair treatment liquid from the tine grooves as the liquid retained in the brush tuft is spread on the hair.

It is an objective of the present invention to provide a brush-comb for applying hair treatment liquid in selected areas of the hair.

BRIEF DESCRIPTION OF THE DRAWINGS

Other objectives and features of the present invention will be apparent from the following detailed description of the preferred embodiment of the invention, taken in conjunction with the accompanying drawings:

In the drawings:

FIG. 1 is a side plan view of the combined brush and comb ("brush-comb") of the present invention;

FIG. 2 is a side plan view of the brush-comb of FIG. 1;

FIG. 3 is a bottom plan view of the brush-comb of FIG. 1;

DETAILED DESCRIPTION

As shown in FIGS. 1–4, the combined brush and comb ("brush-comb") 10, of the present invention, includes a handle portion 11 and a head portion 12.

The handle portion 11 is a flat member as seen in side view, see FIG. 2. Preferably it is formed of a suitable transparent or translucent plastic, for example by injection molding, and is preferably slightly flexible.

Figure 4:
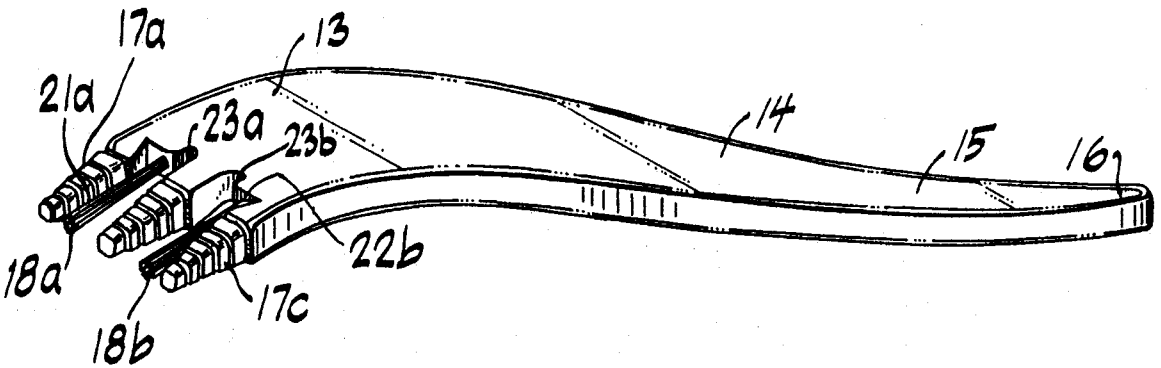
FIG. 4 is a perspective view of the brush-comb of FIG. 1.

As shown in FIGS. 1 and 4, the handle portion 11, as seen in front view, has a relatively wide curved base portion 13, a tapered and curved center portion 14, and an elongated and curved free end portion 15, which terminates in a tip 16. The tip 16 and end portion 15 are designed to be used to part the hair, in a preferred embodiment.

The head portion 12 is at the opposite end of the brush-comb 10 from its free end portion 15. The head portion consists of a plurality of comb tines **17*a*, 17*b*, 17*c* and a plurality of brush tufts 18*a* and 18*b*. The embodiment of FIGS. 1–4** uses three tines and two brush tufts; however, the number of tines may be in the range of from about one to about ten, and the number of brush-tufts may be in the range of from about one to about ten.

Figure 5:
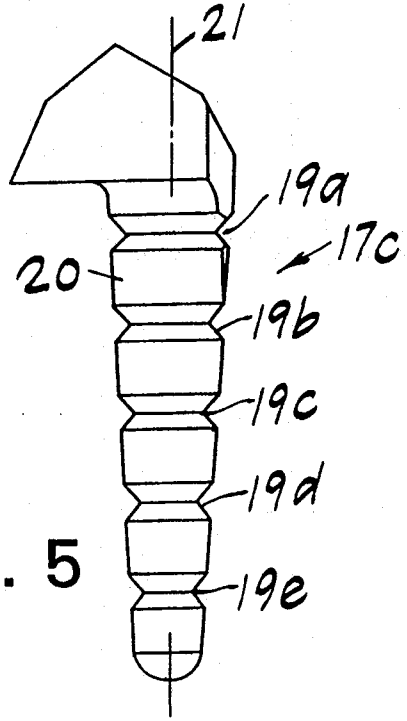
FIG. 5 is an enlarged perspective view of a tine of the brush-comb of FIG. 1.

The comb tines **17*a*–17*c* are preferably integral with the body portion 11 and consequently are of a slightly flexible plastic material. As shown in FIG. 5, each tine is tapered and has at least one groove and may have a plurality of parallel grooves 19*a*, 19*b*, 19*c*, 19*d*, 19*e***.

The grooves **19*a*–19*e* are inwardly directed from the surface 20 of the tine 17*c* and the grooves 19*a*–19*e* are in imaginary planes perpendicular to the imaginary axis 21 of tine 17*c*. Preferably each tine has the same shape, size and number of grooves. Preferably each tine is rectangular in cross-section perpendicular to its axis and each groove is continuous around the tine, i.e., on all four sides in a rectangular tine. However, the tines may be round or oval or have other cross-sectional shapes. Each tine has at least one continuous surface groove. Preferably, the tines have a plurality of grooves which are evenly spaced and preferably there are not more than about ten of such grooves on each tine. However, the grooves need not be continuous and may be unevenly spaced. The grooves are designed to pick up and retain the hair treatment liquid and act as reservoirs of the liquid for the brush tufts 18*a*–18*b***, increasing the liquid holding capacity of the brush-comb.

The grooves **19*a*–19*b* are preferably formed having angled side walls, preferably at angles of 45°; although, alternatively the grooves may be formed with angled walls of other angles or may be hemispheric or otherwise rounded. The grooves are preferably about 0.02 inches deep and in the range of about 0.01 to 0.05 inches deep. The tines 17***a* and 17*c* are closely proximate the brush tufts 18*a* and 18*b*, respectively. The close proximity of the brush tufts 18*a* and 18*b* with the tines 17*a* and 17*c*, respectively, forms reservoirs 21*a* and 21*b* between the tines and brush tufts to retain the hair treatment liquid and increase the liquid holding capacity of the brush-comb.

The hair treatment liquid taken up in the grooves on the tines 17*a* and 17*c* is transferred to the brush tufts 18*a* and 18*b*, respectively, to replenish the liquid originally taken up by those brush tufts. As the hair is treated the liquid originally taken up by the brush tufts is spread on the hair and is then replenished in the brush tufts from the liquid picked up and retained in the grooves of tines 17*a*–17*c* and in the reservoirs 21*a* and 21*b* formed between the brush tufts and their adjacent tines.

Preferably each brush tuft consists of a plurality of individual elongated bristles, for example of nylon. Typically the strands are relatively stiff and are in the range of about four to about twenty in number, preferably about twelve to about sixteen and most preferably about fourteen. The bristles are preferably a stiff nylon material and about one-half inch in length, measured from their fastening points to their free tips. Each bristle is preferably about 0.016 inches in diameter. The tines are also preferably about one-half inch in length and taper to a width of about 1/10 inch at their tips. Each brush tuft is spaced preferably about 1/16 inch from the side of its proximate tine to form reservoirs (gaps) 21*a* and 21*b* therewith and is spaced from its adjacent tine in the range of about 1/32 inch to about 3/32 inch, measured from the center of the brush tuft holes 22*a* and 22*b*. In any event, the reservoir gap is sufficiently small so that the treatment liquid is retained therein. The brush tufts 18*a* and 18*b* are held, at their end, in a stainless steel clip and they are retained in holes 22*a* and 22*b*, respectively, by a friction fit, or alternatively by a suitable adhesive or by both an adhesive and friction-fit.

The end of the head portion 13 ("end wall") between the brush tufts 18*a* and 18*b* and the central tine 17*b*, is not flat; but instead is formed with rounded indentations 23*a* and 23*b* on opposite sides of the base of tine 17*b*. The indentations 23*a* and 23*b* prevent the build-up of treatment liquid which may occur if the end surface were flat, i.e., formed as a shelf. Such a build-up of liquid is undesirable as it may cause an uneven application of the treatment liquid.

In operation, the head portion is dipped into a container of the hair treatment liquid ("treatment liquid"). The treatment liquid, such as a hair dye or a hair bleach, is preferably sufficiently viscous enough to be retained by the three reservoir volumes of the brush-comb; namely, the tine grooves, the brush tufts and the spaces between the brush tufts and their adjacent tines. The term "treatment liquid" includes all hair treatment products which may be applied to the hair by the brush-comb and may be a viscous solution, suspension or gel. Preferably the liquid is thixotropic (i.e., gel-like). For example, if the liquid is a hair dye, its viscosity is preferably from about 500 cps to about 55,000 cps and most preferably about 1000 cps to about 25,000 cps (measured at 25° C. —Brookfield Viscometer). For example, if the liquid is a hair bleach, its viscosity is preferably from about 2000 cps to about 55,000 cps, and most preferably from about 6000 cps to about 25,000 cps (measured at 25° C. —Brookfield Viscometer). In use, some of the treatment liquid will be retained in the brush tufts, additional treatment liquid will be retained in the tine grooves, and additional liquid will be retained in the reservoirs between the brush tufts and their adjacent tines. The user may select areas or strands of the hair and pull the brush-comb head portion through, or preferably lightly touching the surface (top) of the selected areas. The liquid will be applied from the brush tufts and tines to the hair to form "tones" i.e., colored touches or short parallel streaks. The brush-comb is replenished with treatment liquid by dipping into the container. The treatment liquid is held within the recesses on the tines (e.g., grooves 19*a*, 19*b*, 19*c*, 19*d*, 19*e*); treatment liquid is held in the space between the brush tufts and their adjacent tines (e.g., reservoirs 21 and 21*b*); and treatment liquid is held within the brush tufts 18*a* and 18*b*; all of these recesses and spaces serving as a limited internal reservoir to hold the treatment liquid. This reduces the need to replenish product. The same brush-comb may be used to form lightened areas by using hair bleach or to form areas of different color, for example, light colored highlighted areas and dark colored lowlighted areas, by using hair dyes of different colors or hues.

We claim:

1. A combined brush-comb adapted to apply touches of hair treatment liquid to a head of human hair, the combined brush-comb comprising a handle means and head means connected thereto and being without an internal liquid reservoir therein;

said handle means providing a handle grip permitting the combined brush-comb to be manipulated by a user's hand;

said head means being adapted to transfer the hair treatment liquid from a container thereof by dipping the head means therein and applying the hair treatment liquid to selected areas of the head of human hair;

said head means comprising comb tines and at least one brush tuft, each combtine being elongated and having a surface thereon and having an imaginary axis and at least one groove in said surface formed in a plane about perpendicular to said axis; said groove being fillable with hair treatment liquid only by dipping the tine into the hair treatment liquid; and said at least one brush tuft comprising a plurality of bristles, said brush tuft being about parallel to one of said comb tines and sufficiently proximate said one of said comb tines to be replenished with hair treatment liquid from said comb tine groove when said groove contains said hair treatment liquid;

wherein said handle means is a generally flat member, in side view, and in front view has a curved base portion, a curved center portion and a curved end portion terminating in a tip.

2. A combined brush-comb as in claim 1 wherein said brush head has three tines and two brush tufts.

3. A combined brush-comb as in claim 1 wherein the number of grooves is in the range of about 1 to about 10.

4. A combined brush-comb as in claim 3 wherein the number of grooves is about 5.

5. A combined brush-comb as in claim 1 wherein said handle means terminates in an elongated tip adapted to serve as a pick for separation of one layer of hair from another.

6. A combined brush-comb as in claim 1 wherein said head means has an end wall between said tines, said end wall having at least one indentation therein to prevent build-up of treatment liquid along said end wall.

7. A combined brush-comb as in claim 6 wherein said end wall has a plurality of said indentations therein.

* * * * *